US006179443B1

(12) United States Patent
Weber

(10) Patent No.: US 6,179,443 B1
(45) Date of Patent: Jan. 30, 2001

(54) FLUORESCENT LAMP LENS ASSEMBLY

(75) Inventor: Ronald J. Weber, Bradenton, FL (US)

(73) Assignee: Commercial Refrigerator Door Company, Inc., Sarasota, FL (US)

( * ) Notice: Under 35 U.S.C. 154(b), the term of this patent shall be extended for 0 days.

(21) Appl. No.: 09/343,957

(22) Filed: Jun. 30, 1999

Related U.S. Application Data

(60) Provisional application No. 60/091,189, filed on Jun. 30, 1998.

(51) Int. Cl.[7] ..... F21V 14/00

(52) U.S. Cl. ..... 362/255; 362/26; 362/223; 362/224; 362/256; 362/339; 313/318.02

(58) Field of Search ..... 362/255, 260, 362/223, 222, 224, 26, 256, 355, 339, 340; 313/493, 318.02, 623, 624, 625, 634

(56) References Cited

U.S. PATENT DOCUMENTS

| | | | | |
|---|---|---|---|---|
| 2,741,694 | | 4/1956 | Thomstad | 240/51.11 |
| 2,913,575 | | 11/1959 | Lipscomb | 240/51.11 |
| 3,988,609 | | 10/1976 | Lewin | 240/106 |
| 4,048,537 | * | 9/1977 | Blaidell et al. | 313/489 |
| 4,371,916 | | 2/1983 | De Martino | 362/31 |
| 4,573,111 | | 2/1986 | Herst et al. | 362/337 |
| 4,992,916 | * | 2/1991 | Henkes | 362/255 |
| 5,016,146 | | 5/1991 | Kaspar | 362/92 |
| 5,155,380 | | 10/1992 | Hwang et al. | 307/269 |
| 5,199,786 | | 4/1993 | Baliozian | 362/297 |
| 5,471,372 | | 11/1995 | Mamelson et al. | 362/92 |

* cited by examiner

*Primary Examiner*—Sandra O'Shea
*Assistant Examiner*—Bertrand Zeade
(74) *Attorney, Agent, or Firm*—Holland & Knight LLP

(57) ABSTRACT

A fluorescent lamp lens assembly for commercial display refrigerators, the fluorescent lens assembly being generally tubular in configuration and including a length generally approximating the length of the fluorescent lamp. The fluorescent lamp is positioned into the lens assembly and held in concentric relation therein by means of a pair of end caps securing the fluorescent lamp within the tubular lens. Both of the caps allow the terminal pins of the fluorescent lamp to extend outwardly allowing the pins to connect to the lamppost of a conventional fluorescent lamp fixture. One of the ends (e.g., the top end) is provided with a removable cap allowing a spent lamp to be removed therefrom and replaced with a new one.

9 Claims, 7 Drawing Sheets

FLUORESCENT LAMP LENS ASSEMBLY

CROSS-REFERENCE TO RELATED APPLICATIONS

This application is a regular utility application of provisional application Ser. No. 60/091,189 filed Jun. 30, 1998, from which priority is claimed.

BACKGROUND OF THE INVENTION

1. Field of the Invention

This invention relates to commercial display refrigerators having glass doors for allowing viewing of merchandise contained within the refrigerator. More particularly, this invention relates to fluorescent lights that are employed within commercial display refrigerators for illuminating the merchandise contained therein.

2. Description of the Background Art

Presently, display refrigerators are commonly used in retail stores such as grocery and convenience stores, for refrigerating merchandise such as beverages behind glass doors allowing the discriminating shopper to view the merchandise while shopping. Once the selection is made, the shopper may then open the glass door and remove the product from the refrigerator.

In order to minimize the shopper's viewing convenience while minimizing the tendency of the shopper to open the glass doors during the selection process, it has been desirable to fully illuminate the merchandise. In this manner, the shopper will hopefully not stand with the display door open while making the selection. Rather, the shopper will properly make the selection with the door closed and then open it when the selection is made. Hence, there has been a desire in the industry for illumination systems that fully illuminate the merchandise contained within the display refrigerator without obstructing the view thereof.

Presently, there exist various configurations of lighting systems for display refrigerators in which the fluorescent lamp fixture is positioned horizontally at the top or bottom of the merchandise shelving area. More recently, lighting systems have been positioned behind the mullions that support the respective glass doors. By positioning the lighting system behind the mullions, they are generally concealed from view by the shopping consumer and therefore do not otherwise hinder the presentation of the merchandise to the consumer.

Moreover, various lens systems, covers and reflectors have been developed for directing the light rays from the fluorescent light in a direction toward the leading edge of the display shelves so that even the merchandise in the center of the shelf midway between the mullions is fully illuminated. Such lenses and reflectors have also been designed so as to minimize the reflection of light toward the glass doors themselves that would otherwise create a distracting glare on the glass doors (i.e., a "zebra" effect) and thereby not present as pleasing of a shopping environment for the consumer.

U.S. Pat. Nos. 5,016,146 and 5,471,372, the disclosures of which are hereby incorporated by reference herein, illustrate various types of mullion-mounted lighting systems for display refrigerators.

The various configurations of lenses and reflectors employed in mullion-mounted lighting systems have achieved wide acceptance in the industry. Unfortunately, the specific designs for such lighting systems vary from manufacturer to manufacturer. Moreover, the design of such lens covers typically require that the lens be removed in its entirety in order to change the fluorescent lamp contained therein. Thus, there presently exists a need in the commercial refrigerator art for a universal lighting system that accomplishes the objects of illuminating the leading edge of the shelving while minimizing door glare, and yet being able to conveniently change the fluorescent lamp as needed when they become spent (i.e., burned out).

Therefore, it is an object of this invention to provide an improvement which overcomes the aforementioned inadequacies of the prior art devices and provides an improvement which is a significant contribution to the advancement of the commercial display refrigerator art.

Another object of this invention is to provide a universal lens assembly may that be utilized in connection with various types of lighting fixtures.

Another object of this invention is to provide a lens assembly that may accommodate different-diameter fluorescent lamps.

Another object of this invention is to provide a lens assembly that will minimize lamp breakage.

Another object of this invention is to provide a lens that will remain stable in cold temperatures.

Another object of this invention is to provide a lens that fits onto the lamp for the purpose of redirecting the light to the product and out of the customer's eyes.

Another object of this invention is to provide a lens/lamp assembly that also constitutes a sealed assembly that provides insulation for the lamp, thus allowing greater light output.

Another object of this invention is to provide a lens/fluorescent lamp assembly that mounts onto commonly available lamp holder sockets and requires no other fastening means.

Another object of this invention is to provide a lens assembly whereby the end cap can screw down to different heights to adapt to different lamp variations.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

For the purpose of summarizing this invention, this invention comprises a fluorescent lamp lens assembly for commercial display refrigerators. More particularly, the fluorescent lens assembly is generally tubular in configuration and includes a length generally approximating the length of the fluorescent lamp. The fluorescent lamp is inserted into the lens assembly and is held in concentric relation therein by means of a pair of end caps that secure the fluorescent lamp within the tubular lens. Both of the caps allow the terminal pins of the fluorescent lamp to extend outwardly allowing the pins to connect to the lamppost of a conventional fluorescent lamp fixture. One of the ends (e.g., the top end) is provided with a removable cap allowing a spent lamp to be removed therefrom and replaced with a new one.

The tubular lens includes specially-designed prism surfaces on the lumen thereof so as to direct the light outwardly from the sides thereof so as to illuminate the frontmost portion of the display shelves and to reduce glare on the doors. The lens assembly is capable of being used in virtually any type of fluorescent light fixture without special modifications. Thus, the lens assembly of the invention finds utility in display refrigerators of various makes and models.

Thus, the fluorescent lens assembly of the present invention provides a universal lens assembly that may be utilized in connection with various types of lighting fixtures with the capability to accommodate different-diameter fluorescent lamps. Further, due to the protective and insulative nature of the tubular lens, the lens assembly of the present invention also minimizes lamp breakage and provides a lens that remains stable in cold temperatures. The prism aspect of the lens assembly of the present invention redirects light from a fluorescent lamp to shelved products and away from the customer's eyes. The lens assembly of the invention mounts onto commonly available lamp holder sockets and requires no other fastening means. Lastly, the lens assembly of the present invention provides the end cap that can screw down to different heights to adapt to different lamp variations.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
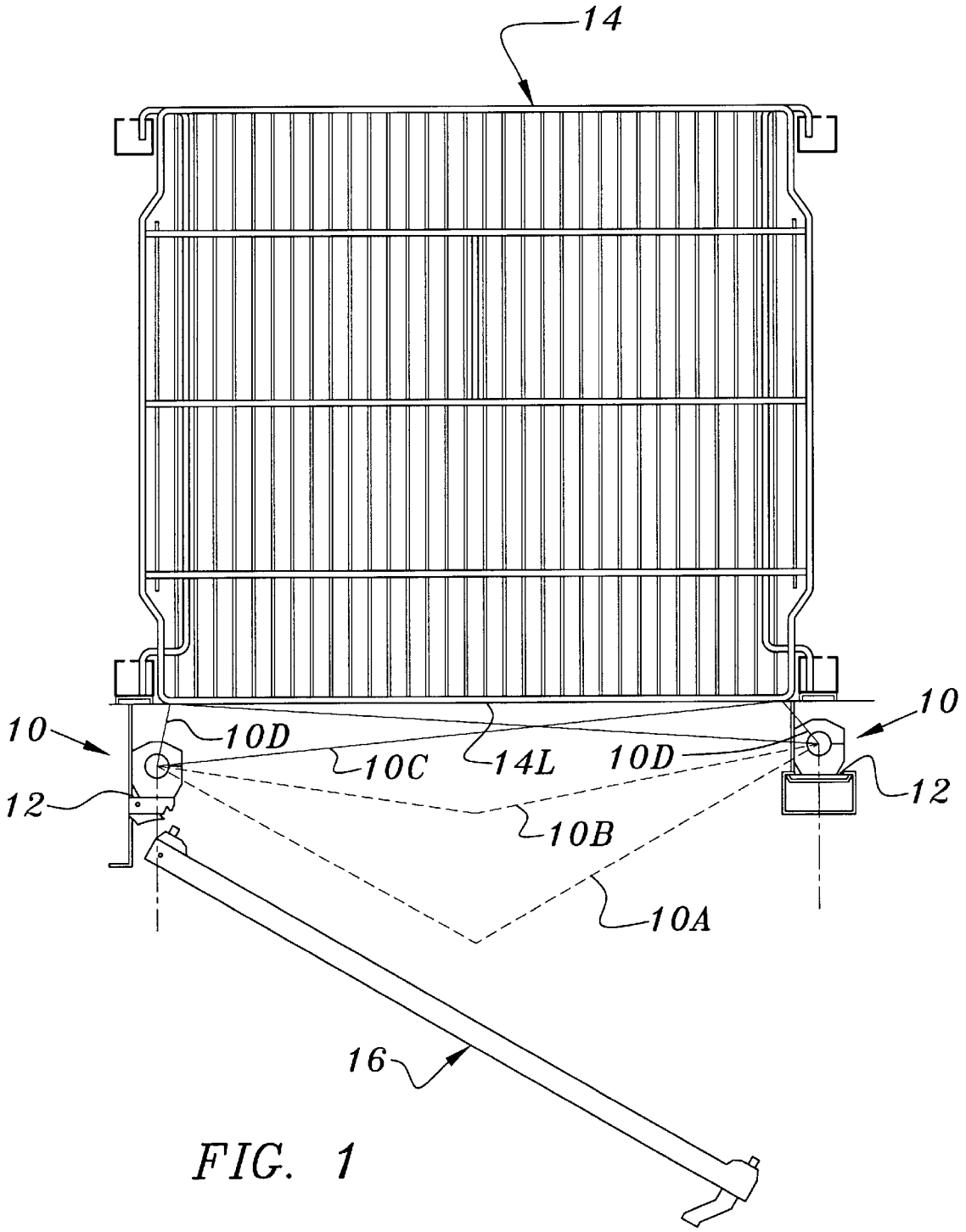
FIG. 1 is a partial plan view of a typical merchandising shelf of a commercial display refrigerator illustrating the placement of the fluorescent lens assembly of the invention at the mullions thereof for illuminating the leading edge of the display shelves.

Referring to FIG. 1., the lens assembly 10 of the invention is intended to be utilized primarily with mullion-mounted light fixtures 12 for commercial display refrigerators for projecting light onto the leading edge 14L of the display shelves 14 while minimizing glare on the glass refrigerator door 16. However, it shall be understood that the lens assembly 10 of the invention may find application in other types of refrigerators or other appliances wherein it is desirable to provide a universal lens assembly 12 for directing light while allowing the fluorescent lamps to be changed as needed.

Figure 2:
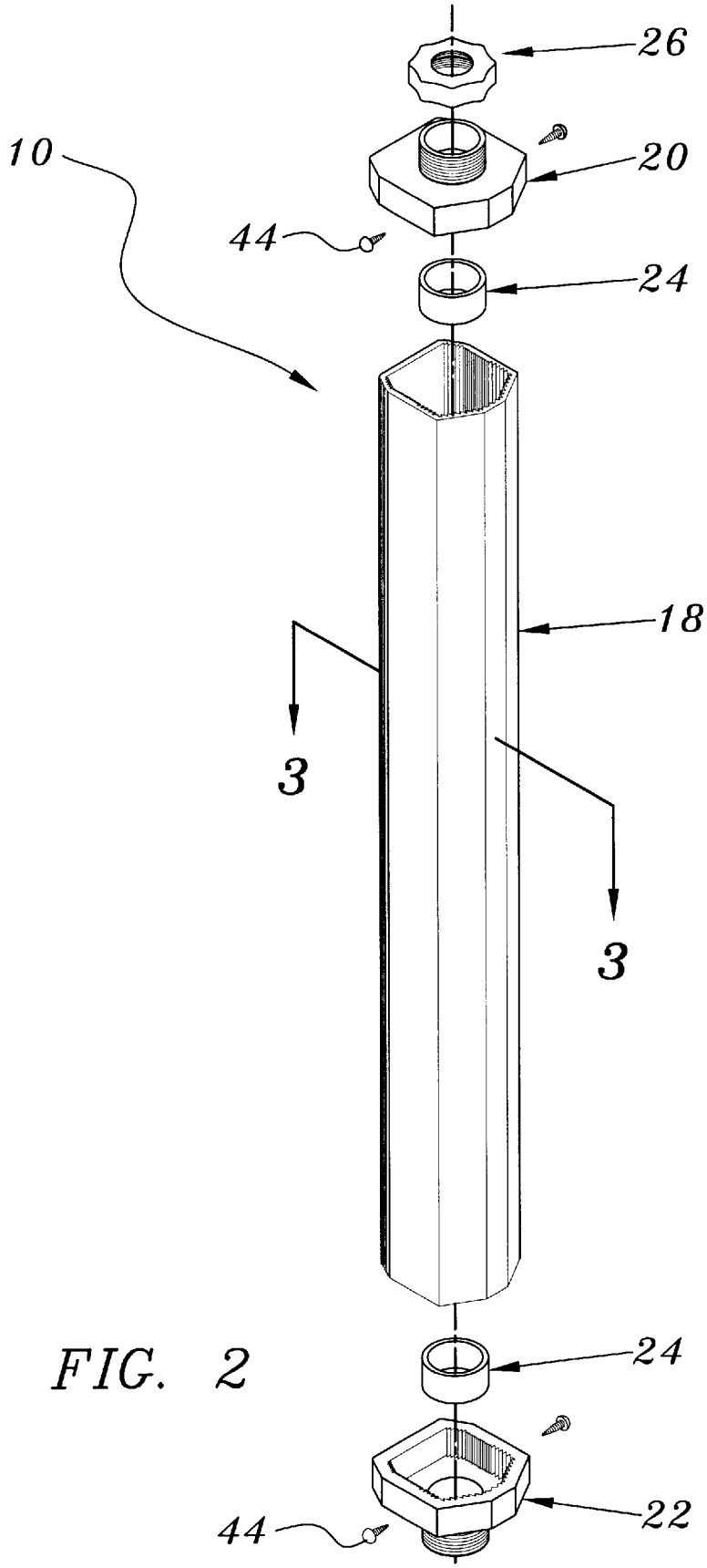
FIG. 2 is an exploded perspective diagram of the lens assembly of the invention illustrating the various components thereof and the manner in which they are assembled.

More particularly, as shown in FIG. 2, the lens assembly 10 of the invention includes a tubular prism lens 18, a top end cap 20, a bottom end cap 22, respective end cap inserts 24 for insertion into the end caps 20 and 22. Finally, to facilitate the changing of the fluorescent lamp, the top end cap 20 is provided with a lamp cap 26.

Figure 3:
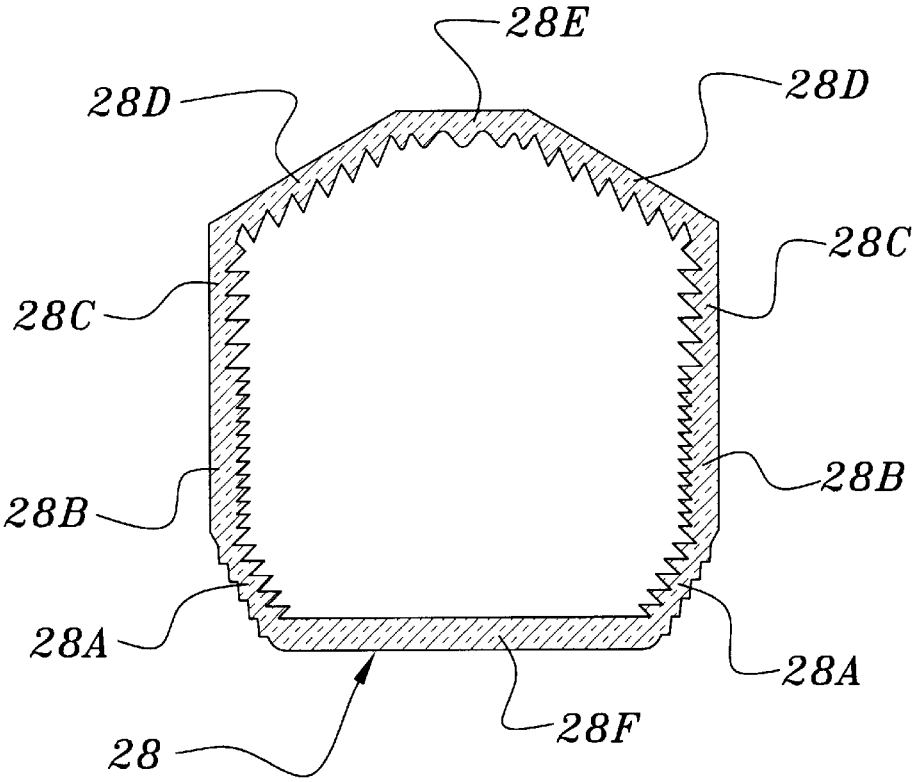
FIG. 3 is a cross-sectional view of FIG. 2 along lines 3—3 illustrating the prisms on the lumen of the lens that are optimally designed to direct light to the leading edge of the shelving while minimizing door glare.

FIG. 3 is a cross-sectional view of the tubular prism lens 18 shown in FIG. 2. More particularly, the tubular prism lens 18 includes a tubular wall 28 having symmetric first, second, third and fourth portions 28A, 28B, 28C and 28D, respectively, an end lens portion 28E and a base portion 28F. The base portion 28F preferably does not include any prism configuration as it is intended to be positioned adjacent to the light fixture 12. The first prism wall portion 28A is configured so as to minimize the light along the path shown by light rays 10A in FIG. 1 that would otherwise cause a glare on the door 16. Prism wall portion 28B is likewise specially configured as to minimize light that may be projected along the direction of light rays 10B as shown in FIG. 1. Prism walls 28C and 28D are each configured so as to project the light from the fluorescent lamp toward the leading edge 14L of the shelving 14 as shown by light rays 10C and 10D, respectively. In this manner, proper illumination of the merchandise on the shelving 14 is achieved while minimizing door glare.

Figure 6:
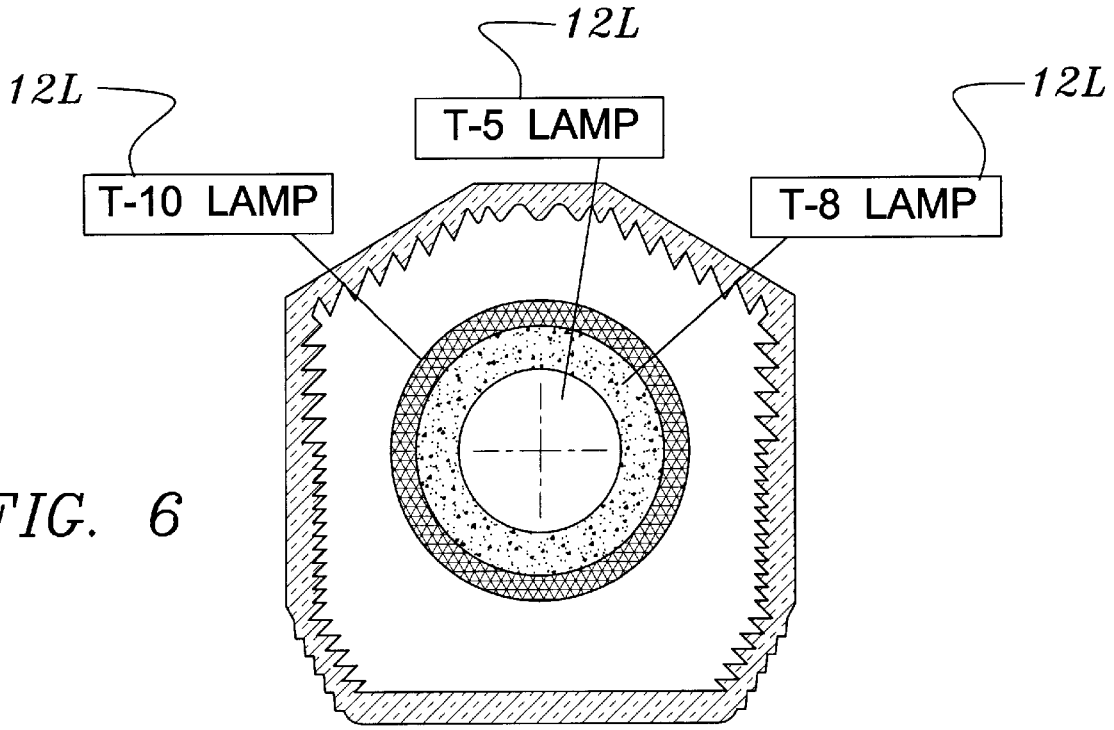
FIG. 6 is a diagrammatic view showing the manner in which the lens assembly, through the use of the end cap insert, can be utilized in conjunction with fluorescent lamps (T-10, T-5 and T-8) of different diameters.
Figure 5:
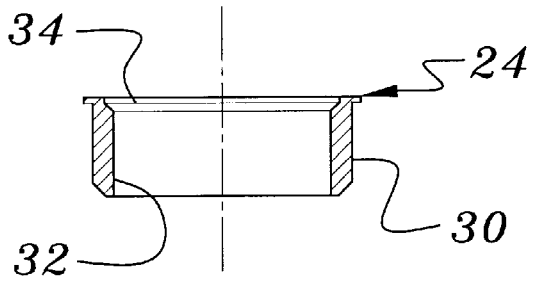
FIG. 5 is a cross-sectional view of FIG. 4 along lines 5—5.
Figure 4:
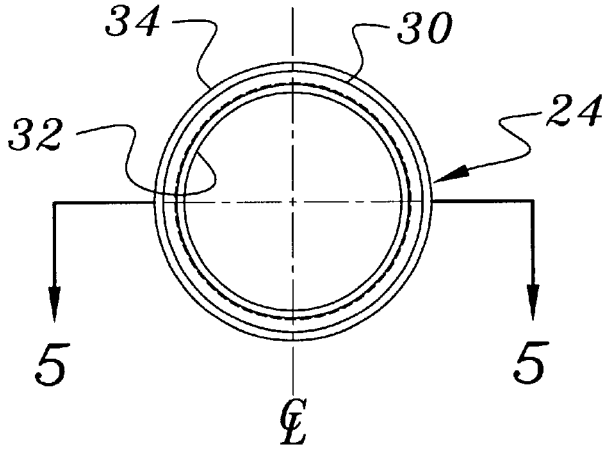
FIG. 4 is a bottom view of a cap insert which allows use of the lens assembly of the invention with various fluorescent lamps of different diameters.

Referring now to FIGS. 4 and 5, the end cap insert 24 of the invention is essentially a collar which accommodates for fluorescent lamps of different diameters. The outermost diameter 30 of the end cap insert 24 is dimensioned to provide an interference fit with the end caps 20 and 22. The inner diameter 32 of the end cap insert 24 is dimensioned to slidably fit over the desired diameter of the fluorescent lamp. In this manner, without use of the end cap insert 24, the larger-diameter fluorescent lamp (e.g., T-10) may be used in the lens assembly 10 of the invention and upon insertion of the end cap insert 24 in the respective end caps 20 and 22, a smaller-diameter fluorescent lamp (e.g., T-8) may be utilized (see FIG. 6). An inwardly-extending flange 34 is provided for convenience in alignment.

Figure 8:
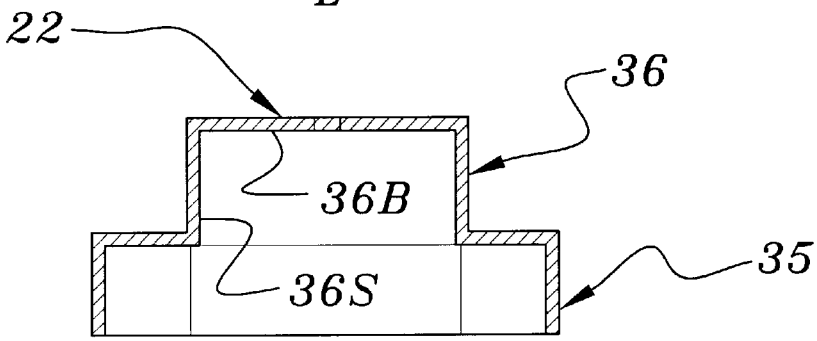
FIG. 8 is a cross-sectional view of FIG. 7 along lines 8—8.
Figure 7:
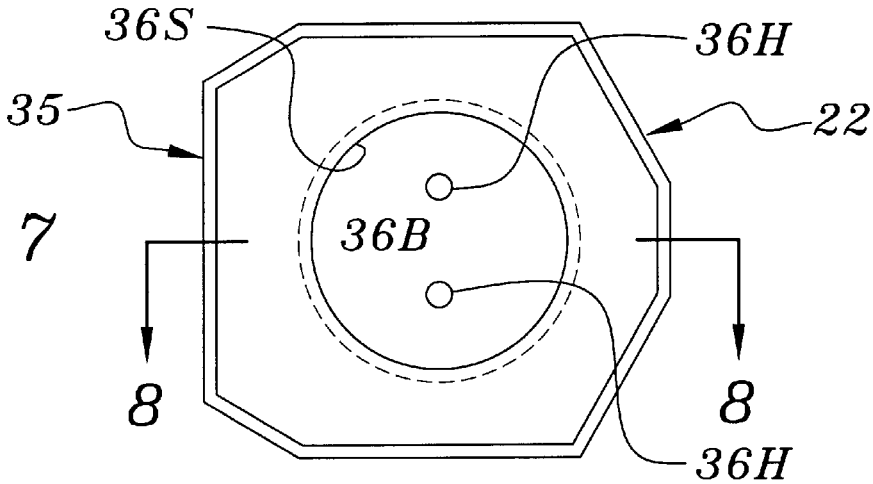
FIG. 7 is a bottom view of the bottom end cap of the invention illustrating the pin holes formed therein for receiving the terminal pins of the fluorescent lamp.

FIGS. 7 and 8 illustrate the bottom end cap 22 of the invention. Basically, the bottom end cap 22 comprises a flared skirt portion 35 having a peripheral cross-sectional configuration corresponding to the cross-sectional configuration of the tubular prism lens 18 so as to be loosely fitted onto the bottom end thereof. The bottom end cap 22 further includes a lamp portion 36 defined by circular side walls 36S and bottom wall 36B. Bottom wall 36B is provided with two holes 36H that are appropriately dimensioned and spaced apart from the longitudinal axis of the bottom end cap 22 so as to receive the terminal pins of the fluorescent lamp. In this manner, the end of the fluorescent lamp may be encompassed by the lamp portion 36 with its terminal pins protruding from the holes 36H. It is noted that if smaller-diameter fluorescent lamps are desired to be used, the end cap insert 24 may be inserted into the lamp portion 36 as described hereinabove.

Figure 10:
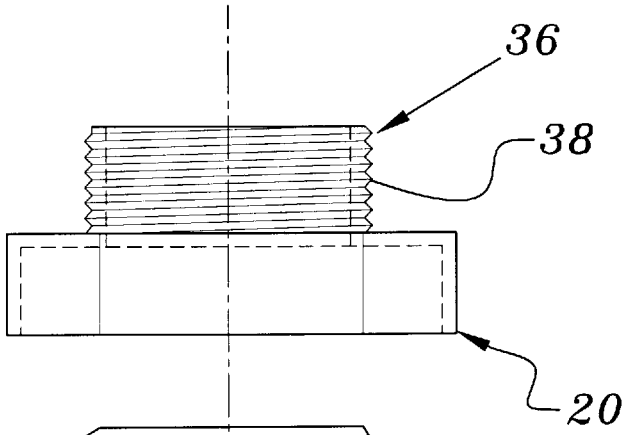
FIG. 10 is a side view of FIG. 9 illustrating the exterior threads thereof for receiving a lamp cap.
Figure 9:
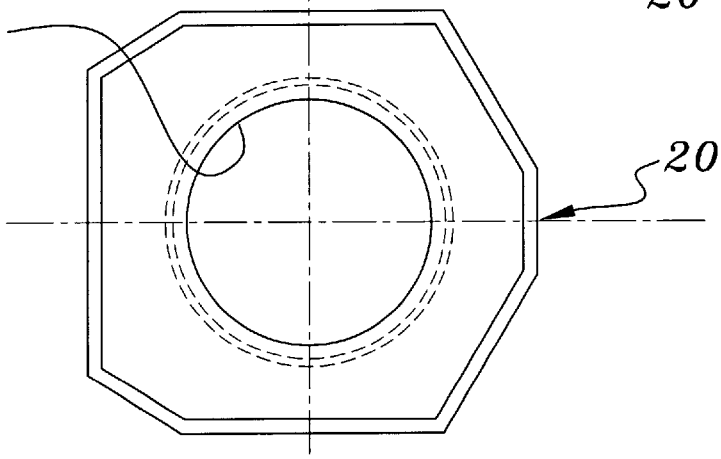
FIG. 9 is a bottom view of the top end cap of the invention.

FIGS. 9 and 10 illustrate the upper end cap 20 as including a configuration substantially similar to that of the bottom end cap 22 allowing it to be slid over the other end of the tubular prism lens 18. However, unlike the bottom end cap 22, the lamp portion 36 of the top end cap 20 includes a thread 38 on the circular side wall 36S. No bottom wall 36B is provided so as to provide an end cap 20 that is open as opposed to being blinded.

Figure 12:
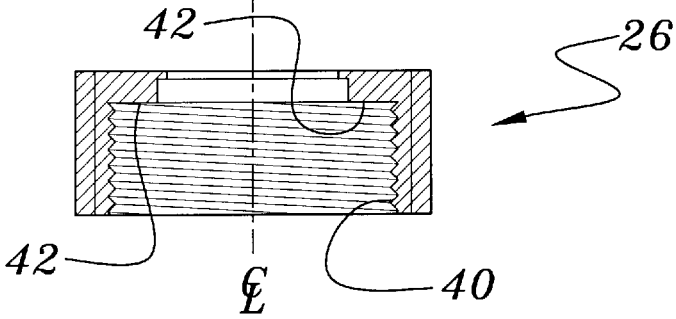
FIG. 12 is a cross-sectional view of FIG. 11 along lines 12—12.
Figure 11:
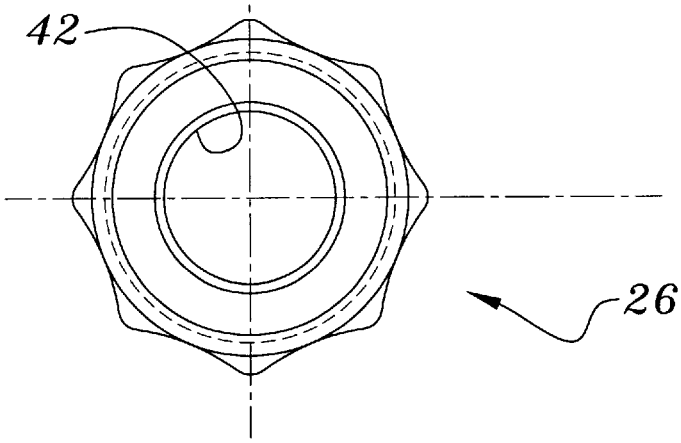
FIG. 11 is a bottom view of the lamp cap of the invention for threaded engagement with the top end cap of FIGS. 9 and 10.

As shown in FIGS. 11 and 12, the lens assembly 10 of the invention further includes a lamp cap 26 having an internal thread 40 for threaded engagement with the thread 38 of the top end cap 20. The lamp cap 26 further includes an annular lip 42 of a diameter that is appreciably less than that of the diameter of the fluorescent lamp.

Figure 13:
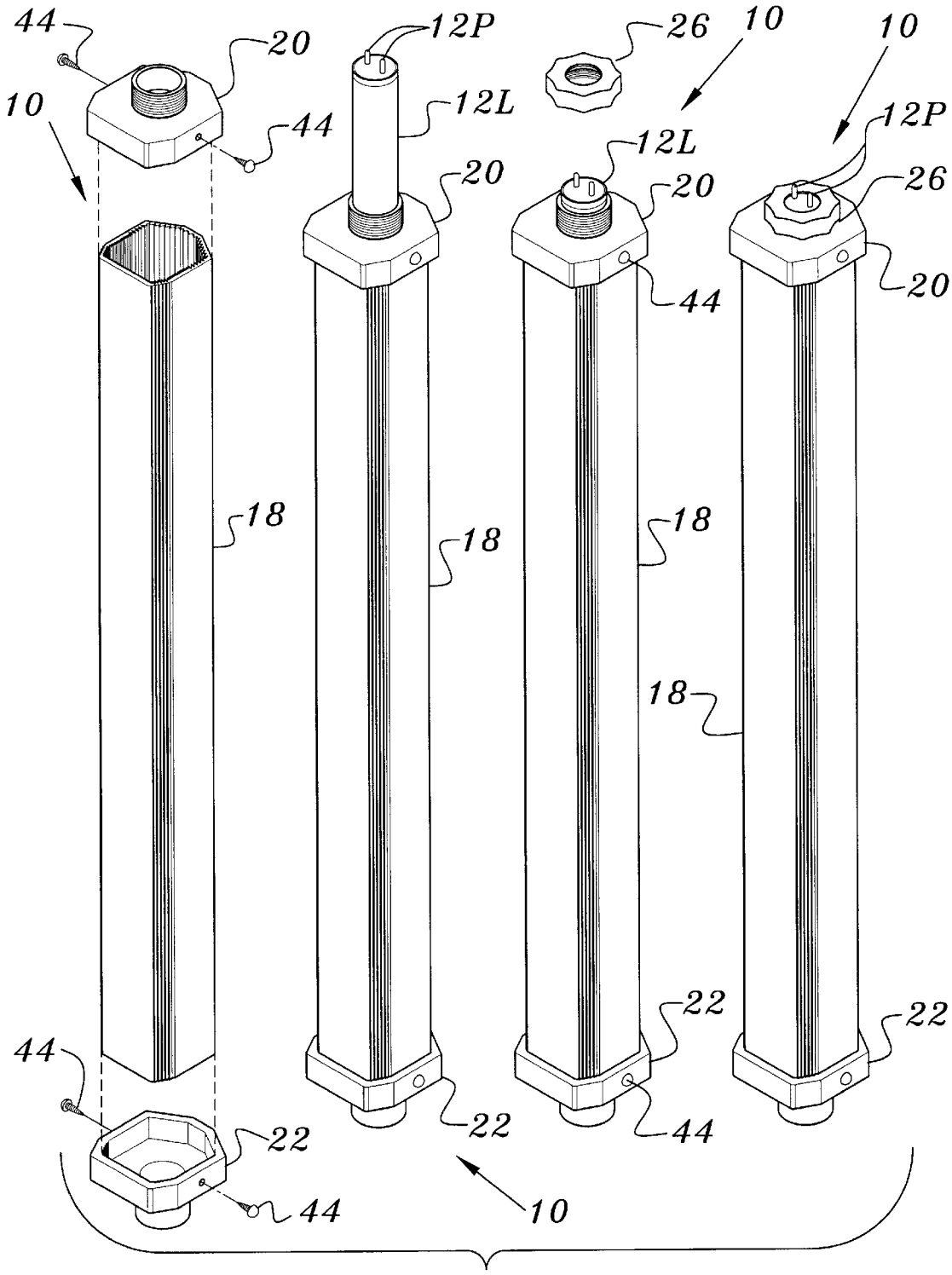
FIG. 13 is diagrammatic view illustrating the assembly of the various components of the invention.

As shown in FIG. 13, assembly of the lens assembly 10 is accomplished as follows. First, the end caps 20 and 22 are positioned over the respective ends of the tubular prism lens 18. Threaded fasteners 44 may be provided for permanent mounting of the end caps 20 and 22. A conventional fluorescent lamp 12L is then inserted into the top of the end cap 20 and rotated so as to align its terminal pins 12P with the holes 36H of the lamp portion 36 of the bottom end cap 22 and extend therethrough. The lamp cap 26 is then threaded onto the top end cap 20. It is noted that the lip 42 thereof results in the fluorescent lamp 12L being entrained between the top and bottom end caps 20 and 22. The final assembly thus comprises an integrated assembly wherein the tubular prism lens 18 is secured about the fluorescent lamp 12L without restricting the manner in which the fluorescent lamp 12L may be installed into a conventional fluorescent lamp fixture 12.

Figure 14:
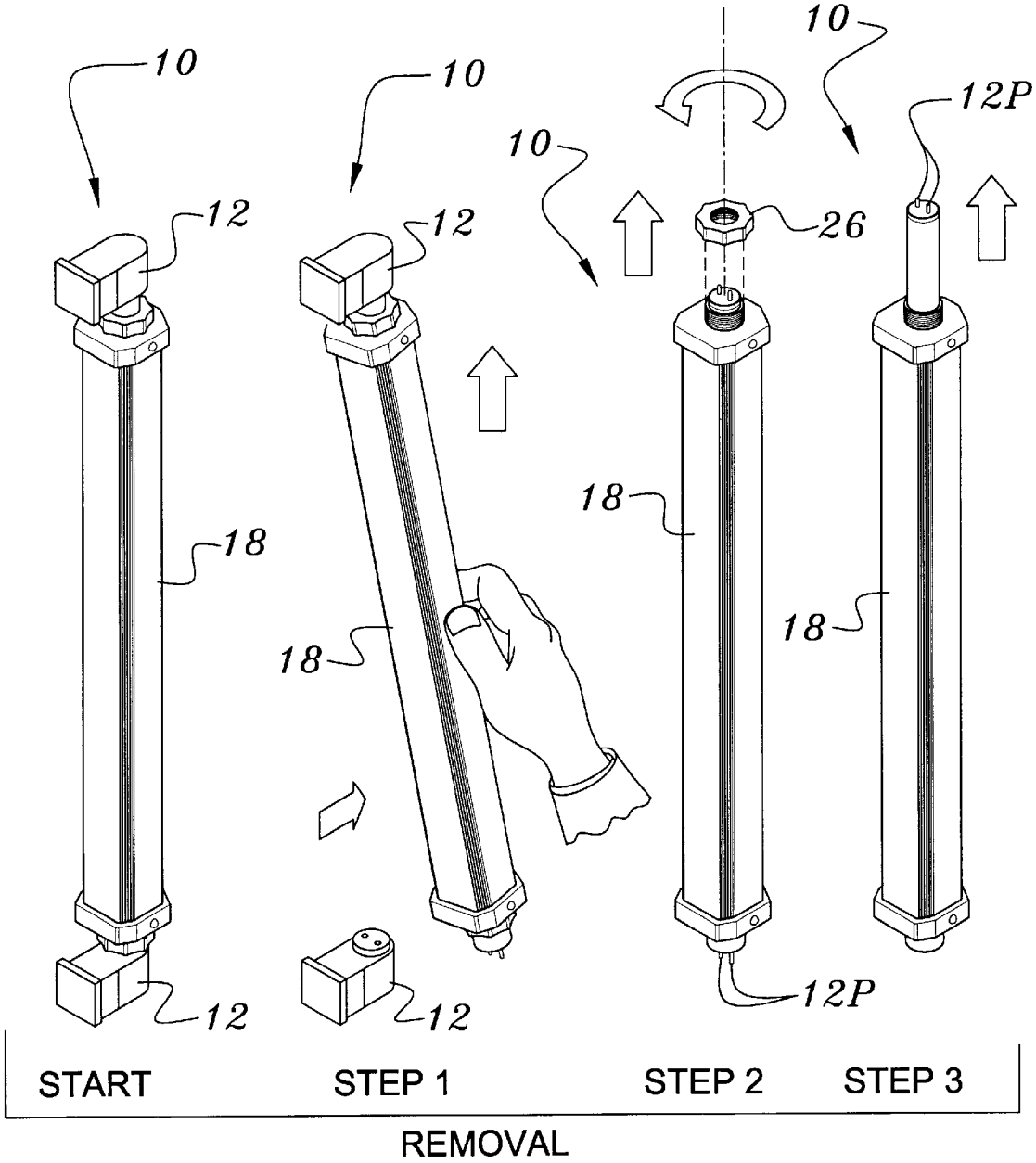
FIG. 14 is a diagrammatic view of the removal of a spent fluorescent lamp and the installation of a new one.

As shown in FIG. 14, the lens assembly 10 containing the fluorescent lamp 12L facilitates the quick removal and installation of the assembly 10 from a conventional light fixture 12 without requiring any modifications or design changes to the fixture 12 itself. This allows the lens assembly 10 of the invention to be utilized with conventional light fixtures 12. Moreover, quick and easy replacement of the fluorescent lamp 12L can be performed as shown in FIG. 14.

Now referring to FIG. 14, replacement of the fluorescent lamp 12L contained within the lens assembly 10 of the invention is accomplished as follows. First, the lens assembly 10 of the invention is disengaged from the lamp fixture 12 by pushing it up and disengaging the bottom pins 12P from the lamp holder 12 whereupon it is then moved downwardly to disengage the pins 12P from the top lamp holder 12 (see Start and Step 1). As shown in step 2, the lamp cap 26 is removed and the spent fluorescent lamp 12 is removed (see Step 3).

Installation of a new fluorescent lamp 12 is accomplished by inserting the new fluorescent lamp 12L into the top end cap 20 with its bottom terminal pins 12P aligned with holes 36H so as to protrude therefrom (see Steps 4 and 5). The entire lens assembly 10 of the invention that contains the fluorescent lamp 12L is then reinstalled into the lamp fixture 12 by inserting the top pins 12P of the fluorescent lamp 12L into the top lamp holder 12 (which is spring-loaded) and then aligning the bottom pins 12P with the bottom lamp holder 12 thereby causing the fluorescent lamp 12L and the lens assembly 10 of the invention to be secured in proper position.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described, what is claimed is:

1. A lens assembly for enclosing a fluorescent lamp having terminal pins adapted for mounting between opposing lampposts of a fluorescent light fixture, comprising in combination:

a tubular lens having at least one elongated wall and having opposing ends thereof in which is positioned the fluorescent lamp, said elongated wall including integrally formed plurality of prisms for projecting the light rays from the fluorescent lamp into the desired direction;

a first end cap and a second end cap positioned about said opposing ends of said tubular lens;

each said end caps including at least one hole for receiving the terminal pins of respective ends of said fluorescent lamp and allowing said terminal pins to project outwardly therefrom, whereby said fluorescent lamp may be installed into said tubular lens such that said plurality of prisms of said tubular lens projects light rays from the fluorescent lamp in at least one desired direction while providing protection and insulation to the fluorescent lamp.

2. The lens assembly as set forth in claim 1, wherein said first end cap comprises at least two of said hole corresponding and aligned with the terminal pins of said fluorescent lamp.

3. The lens assembly as set forth in claim 1, wherein said second end cap comprises a removable lamp cap with a hole allowing the terminal pins to project outwardly therefrom and permitting said fluorescent lamp that is spent to be replaced by removing said lamp cap, then removing the spent fluorescent lamp through said second end cap, installing a new fluorescent lamp, and the installing the lamp cap.

4. The lens assembly as set forth in claim 3, wherein said lamp cap includes a lip for entraining the fluorescent lamp between said end caps.

5. The lens assembly as set forth in claim 1, wherein said tubular lens comprises a plurality of differently-configured said prisms for projecting the light rays from the fluorescent lamp into a plurality of desired directions.

6. The lens assembly as set forth in claim 5, wherein said tubular lens comprises a plurality of said elongated walls and wherein said plurality of differently-configured said prisms are positioned on all but one of respective said plurality of elongated walls of said tubular lens.

7. The lens assembly as set forth in claim 1, wherein said end caps each comprise a flanged skirt portion having a peripheral configuration corresponding to a cross-sectional configuration of said opposing ends of said tubular lens so as to be positioned thereon and a lamp portion generally circular in cross-section for receiving opposing ends of said fluorescent lamp.

8. The lens assembly as set forth in claim 7, further including a pair of end cap inserts for insertion into respective said end caps to accommodate fluorescent lamps of different diameters.

9. The lens assembly as set forth in claim 8, wherein said cap inserts includes an outer diameter to interference fit into said lamp portion and an inner diameter to receive an end of the fluorescent lamp, thereby accommodating fluorescent lamps of different diameters.

* * * * *